US009039396B2

(12) United States Patent
Ignatiev

(10) Patent No.: US 9,039,396 B2
(45) Date of Patent: May 26, 2015

(54) PISTON AND SCROLL COMPRESSOR ASSEMBLY

(71) Applicant: Emerson Climate Technologies, Inc., Sidney, OH (US)

(72) Inventor: Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1 day.

(21) Appl. No.: 13/930,979

(22) Filed: Jun. 28, 2013

(65) Prior Publication Data

US 2014/0010695 A1 Jan. 9, 2014

Related U.S. Application Data

(60) Provisional application No. 61/667,700, filed on Jul. 3, 2012.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/02*** | (2006.01) |
| ***F01C 17/06*** | (2006.01) |
| ***F01C 1/02*** | (2006.01) |
| ***F04C 23/00*** | (2006.01) |
| ***F04B 23/12*** | (2006.01) |
| ***F04B 41/06*** | (2006.01) |

(52) U.S. Cl.

CPC ..... *F04C 18/023* (2013.01); *F01C 17/06* (2013.01); *F01C 1/0215* (2013.01); *F01C 17/063* (2013.01); *F04C 23/001* (2013.01); *F01C 17/066* (2013.01); *F04C 23/005* (2013.01); *F04C 23/008* (2013.01); *F04C 18/0215* (2013.01); *F04B 23/12* (2013.01); *F04B 41/06* (2013.01)

(58) Field of Classification Search

USPC ..... 418/3, 5, 55.1–55.6, 57, 60, 270; 417/201–206, 244–245, 410.5

See application file for complete search history.

(56) References Cited

U.S. PATENT DOCUMENTS

| | | | | |
|---|---|---|---|---|
| 3,467,300 | A | 9/1969 | Schibbye | |
| 4,662,826 | A * | 5/1987 | Nitta et al. | 417/206 |
| 4,910,972 | A | 3/1990 | Jaster | |

(Continued)

FOREIGN PATENT DOCUMENTS

| | | | |
|---|---|---|---|
| EP | 2497954 | A2 | 9/2012 |
| JP | 11141483 | A | 5/1999 |
| WO | 2005050107 | A2 | 6/2005 |

OTHER PUBLICATIONS

PCT International Search Report regarding application No. PCT/US2014/018371 dated Jul. 9, 2014.

(Continued)

*Primary Examiner* — Theresa Trieu

(74) *Attorney, Agent, or Firm* — Harness, Dickey & Pierce, P.L.C.

(57) ABSTRACT

A compressor is provided and may include a shell, a motor assembly, a drive shaft, a first compression mechanism, and a second compression mechanism. The motor assembly may be disposed within the shell. The drive shaft may be powered by the motor assembly. The first compression mechanism may be disposed within the shell and may be driven by the motor assembly. The second compression mechanism may be driven by the motor assembly.

16 Claims, 4 Drawing Sheets

(56) References Cited

U.S. PATENT DOCUMENTS

| | | | | |
|---|---|---|---|---|
| 5,277,554 | A | 1/1994 | Elson | |
| 6,257,840 | B1 * | 7/2001 | Ignatiev et al. | 418/55.6 |
| 6,267,572 | B1 * | 7/2001 | Suefuji et al. | 418/5 |
| 6,672,846 | B2 | 1/2004 | Rajendran et al. | |
| 7,201,567 | B2 | 4/2007 | Wiertz et al. | |
| RE40,400 | E | 6/2008 | Bass et al. | |
| 7,896,629 | B2 | 3/2011 | Ignatiev et al. | |
| 8,118,563 | B2 | 2/2012 | Chen et al. | |
| 2007/0160482 | A1 * | 7/2007 | Inoue | 417/206 |
| 2009/0007588 | A1 | 1/2009 | Shaw | |
| 2009/0277215 | A1 | 11/2009 | Tsuboi | |
| 2012/0100025 | A1 | 4/2012 | Watts et al. | |

OTHER PUBLICATIONS

PCT Written Opinion of the International Searching Authority regarding application No. PCT/US/2014/018371 dated Jul. 9, 2014.

* cited by examiner

PISTON AND SCROLL COMPRESSOR ASSEMBLY

CROSS-REFERENCE TO RELATED APPLICATIONS

This application claims the benefit of U.S. Provisional Application No. 61/667,700, filed on Jul. 3, 2012. The entire disclosure of the above application is incorporated herein by reference.

FIELD

The present disclosure relates to a compressor and more particularly to a piston and scroll compressor assembly.

BACKGROUND

This section provides background information related to the present disclosure and is not necessarily prior art.

Compressors are used in a wide range of applications to compress a fluid to a desired pressure. For example, compressors may be used in refrigeration or heat-pump systems to provide the system with a desired heating and/or cooling effect. Applications incorporating a refrigeration or heat-pump system are numerous and, as such, a variety of different compressor configurations including scroll, reciprocating, and rotary vane—just to name a few—have been designed to match the strengths of a particular compressor design with the particular system in which the compressor is installed.

Regardless of the particular application and compressor design, efficient and reliable operation of the compressor is required, as efficient and reliable operation of the compressor results in efficient and reliable operation of the system. Allowing a compressor to efficiently compress a fluid within a wide range of pressures provides the compressor with the ability to be incorporated into various systems and provides the various systems with a fluid at a desired pressure while concurrently operating efficiently.

SUMMARY

This section provides a general summary of the disclosure, and is not a comprehensive disclosure of its full scope or all of its features.

A compressor is provided and may include a shell, a motor assembly, a drive shaft, a first compression mechanism, and a second compression mechanism. The motor assembly may be disposed within the shell. The drive shaft may be powered by the motor assembly. The first compression mechanism may be disposed within the shell and may be driven by the motor assembly. The first compression mechanism may include a first member orbiting relative to a second member to compress a fluid therebetween. The second compression mechanism may be driven by the motor assembly and including a third member reciprocating relative to a fourth member to compress said fluid therebetween.

In some embodiments, the first member may include an orbiting scroll and the second member may include a non-orbiting scroll.

In some embodiments, the first member may include an orbiting rotor of a rotary vane compressor, and the second member may include a rotor housing of the rotary vane compressor.

In some embodiments, the third member may include a piston and the fourth member may include a cylindrical bore in which the piston reciprocates.

A compressor is provided and may include a first scroll member having a first scroll wrap extending from a first end plate and a second scroll member having a second scroll wrap extending from a second end plate, whereby the second scroll wrap is intermeshed with the first scroll wrap. A discharge passage may extend through the first end plate and may be in fluid communication with a discharge fitting. The compressor may also include a structure in fluid communication with the discharge fitting and a piston slidably disposed within the structure. A motor assembly may drive the second scroll member and the piston and may cause relative orbital movement between the first and second scroll members and relative reciprocating movement between the piston and the structure.

A method is provided and may include providing a motor assembly driving a first compression mechanism and a second compression mechanism, providing a fluid at a first pressure to the first compression mechanism, and compressing the fluid to a second pressure in the first compression mechanism. The method may also include providing the fluid substantially at the second pressure to the second compression mechanism and compressing the fluid to a third pressure in the second compression mechanism, whereby the third pressure is greater than the second pressure.

In some embodiments, the method may include housing the first compression mechanism and at least a portion of the second compression mechanism within a hermetically sealed shell.

In some embodiments, the method may include cooling the fluid in a heat exchanger after compressing the fluid to the second pressure in the first compression mechanism and before compressing the fluid to the third pressure in the second compression mechanism.

In some embodiments, compressing the fluid to the second pressure may include compressing the fluid between cooperating first and second scroll members.

In some embodiments, the compressing the fluid to the third pressure may include compressing said fluid in a piston-cylinder compression mechanism.

In some embodiments, the method may include controlling fluid flow through an inlet of the second compression mechanism and controlling fluid flow through an outlet of the second compression mechanism.

In some embodiments, compressing the fluid to the second pressure may include compressing the fluid to about 2000 pounds per square inch, for example.

In some embodiments, compressing the fluid to the third pressure may include compressing the fluid to about 3600 pounds per square inch, for example.

In some embodiments, the method may include providing the fluid to the first compression mechanism from a conduit in communication with a public source of natural gas.

In some embodiments, the method may include providing the fluid at the third pressure to a fuel-storage tank.

In some embodiments, the method may include drivingly engaging the first and second compression mechanisms with a drive shaft of the motor assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
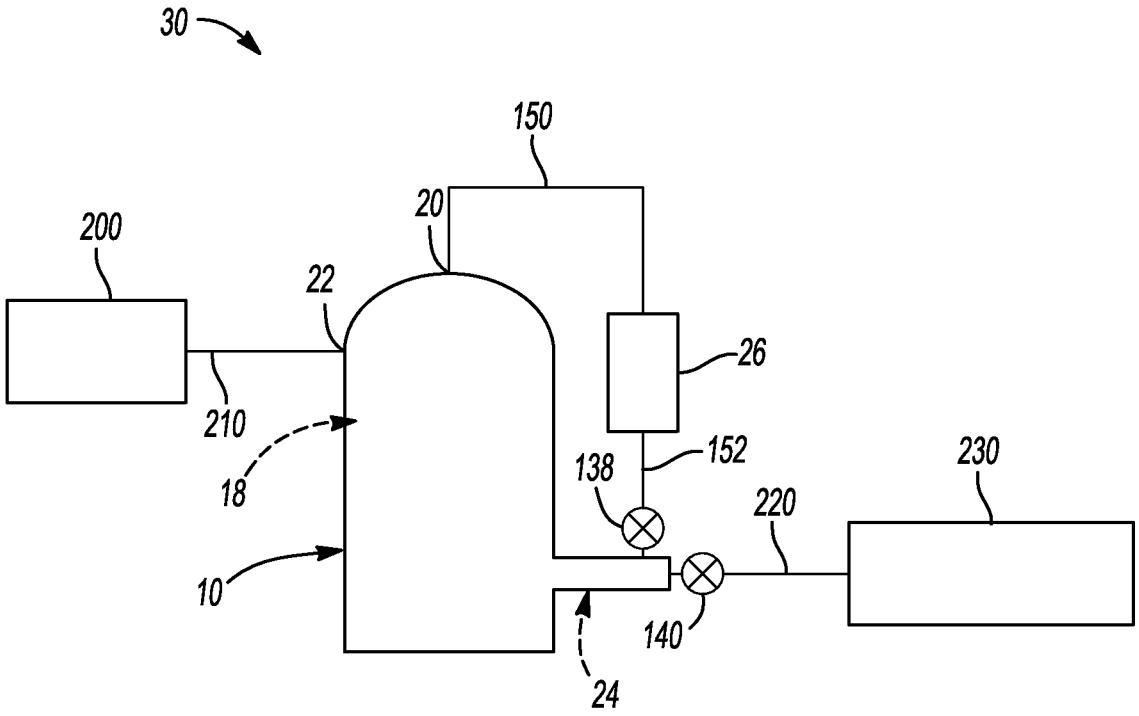
FIG. 1 is a schematic representation of a filling system incorporating a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
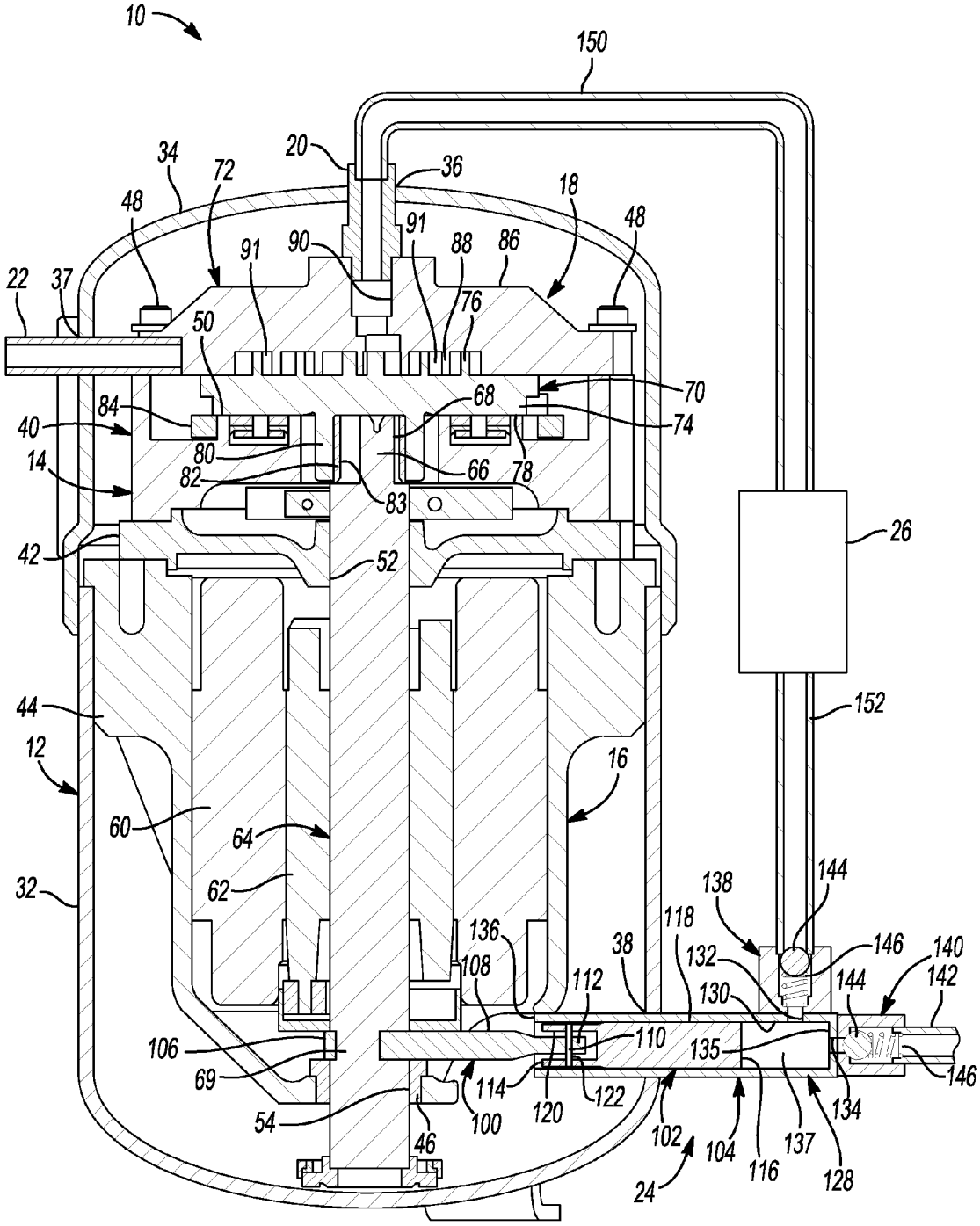
FIG. 2 is a cross-sectional view of the compressor of FIG. 1 including a piston in a first position.
Figure 3:
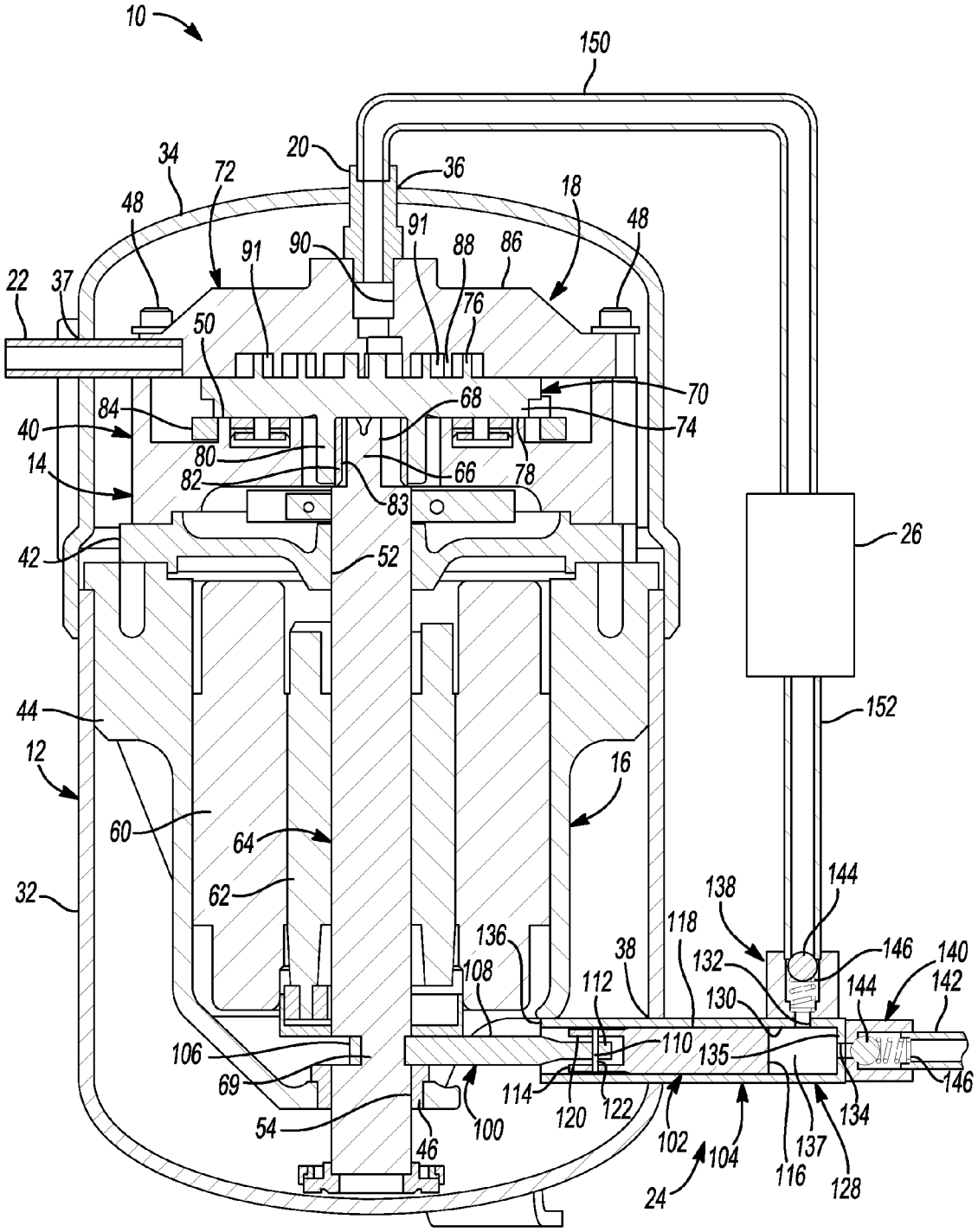
FIG. 3 is a cross-sectional view of the compressor of FIG. 1 including a piston in a second position.

With reference to FIGS. 1-3, a compressor 10 is provided and may include a hermetic shell assembly 12, a bearing assembly 14, a motor assembly 16, a first-compression mechanism 18, a discharge fitting 20, a suction fitting 22, a second compression mechanism 24, and a heat exchanger 26. The compressor 10 may be incorporated into a system 30, as shown in FIG. 1, and may compress a fluid such as, for example, natural gas, refrigerant, or other fuel or working fluid. As will be subsequently described, the first-compression mechanism 18 may compress the fluid to a first discharge pressure. The second compression mechanism 24 may receive the fluid from the first-compression mechanism 18 and further compress the fluid to a second discharge-pressure that is higher than the first discharge pressure.

The shell assembly 12 may house the bearing assembly 14, the motor assembly 16, the first-compression mechanism 18, and at least portion of the second compression mechanism 24. The shell assembly 12 may form a hermetically sealed compressor housing and may include a cylindrical shell 32 and an end cap 34 at an upper end thereof. The discharge fitting 20 is attached to the shell assembly 12 at an opening 36 in the end cap 34 and may be in communication with a discharge-valve assembly (not shown) to prevent a reverse-flow condition. The suction fitting 22 is attached to the shell assembly 12 at an opening 37 while the second compression mechanism 24 extends through the shell 32 at an opening 38 (FIG. 2).

The bearing assembly 14 may include a first-bearing-housing member 40, a first bearing 42, a second-bearing-housing member 44, and a second bearing 46. The second-bearing-housing member 44 may be fixed to the shell 32 at one or more points in any desirable manner, such as staking, welding, and/or via fasteners, for example. The first-bearing-housing member 40 and the first bearing 42 may be fixed relative to the second-bearing-housing member 44 via fasteners 48. The first-bearing-housing member 40 may be an annular member including a thrust bearing 50 on an axial end surface thereof. The first bearing 42 may be disposed between the first and second bearing housing members 40, 44 and includes a first-annular-bearing surface 52. The second bearing 46 may be supported by the second-bearing-housing member 44 and includes a second-annular-bearing surface 54.

The motor assembly 16 is disposed within the shell assembly 12 and may include a motor stator 60, a rotor 62, and a drive shaft 64. The motor stator 60 may be press fit into the second-bearing-housing member 44 or the shell 32. The rotor 62 may be press fit on the drive shaft 64 or otherwise fixed thereto. The drive shaft 64 may be rotatably driven by the rotor 62, may be supported for rotation by the first and second bearings 42, 46, and may include a first-eccentric portion 66 having a flat 68 and a second-eccentric portion 69. The first-eccentric portion 66 may be disposed at a first end of the drive shaft 64 and the second-eccentric portion 69 may be spaced apart from the first-eccentric portion 66 and may be disposed at or near a second end of the drive shaft 64. While the second-eccentric portion 69 is shown in FIGS. 2 and 3 being adjacent to the second bearing 46, the second-eccentric portion 69 could be disposed at any other location along the length of the drive shaft 64. The first and second eccentric portions 66, 69 may be angularly spaced apart from each other by about one-hundred-and-eighty (180) degrees to rotationally balance the drive shaft 64. Additionally or alternatively, one or more counterweights (not shown) may be attached to the drive shaft 64 to rotationally balance the drive shaft 64.

The first-compression mechanism 18 includes an orbiting scroll 70 and a non-orbiting scroll 72. The orbiting scroll 70 includes an end plate 74 having a spiral vane or wrap 76 on the upper surface thereof and an annular thrust surface 78 on the lower surface. The thrust surface 78 may interface with the annular thrust bearing surface 50 on the first-bearing-housing member 40. A cylindrical hub 80 may project downwardly from the thrust surface 78 and may include a drive bushing 82 disposed therein. The drive bushing 82 may include an inner bore 83 in which the first-eccentric portion 66 of the drive shaft 64 is disposed. The flat 68 on the first-eccentric portion 66 may drivingly engage a flat surface in a portion of the inner bore of the drive bushing 82 to provide a radially compliant driving arrangement. An Oldham coupling 84 may be engaged with the orbiting and non-orbiting scrolls 70, 72 to prevent relative rotation therebetween.

The non-orbiting scroll 72 may include an end plate 86 having a spiral wrap 88 on a lower surface thereof and a discharge passage 90 extending through the end plate 86 and in fluid communication with the discharge fitting 20. The spiral wrap 88 meshingly engages the spiral wrap 76 of the orbiting scroll 70, thereby creating a series of moving pockets 91. The pockets 91 defined by the spiral wraps 76, 88 decrease in volume as they move from a radially outer position to a radially inner position throughout a compression cycle of the first-compression mechanism 18.

The second compression mechanism 24 may include a connecting rod 100, a piston 102, and a structure 104. The connecting rod 100 may include a ring portion 106 and an elongated portion 108. The ring portion 106 may engage the second-eccentric portion 69 of the drive shaft 64 and may be free to rotate about the second-eccentric portion 69. The elongated portion 108 may extend radially outward from the ring portion 106 and may include an aperture 110 at a distal end 112 thereof.

The piston 102 may be a generally cylindrical member including a first end 114, a second end 116, and an outer diameter 118. The first end 114 may include an axially extending recess 120 receiving the distal end 112 of the connecting rod 100 therein. A piston pin 122 may be fixed within the recess 120 and may span a diameter of the recess 120. The piston pin 122 may be positioned relative to the connecting rod 100 such that the aperture 110 of the connecting rod 100 rotatably engages the piston pin 122.

The structure 104 may extend through the opening 38 in the shell 32 and may include a body 128, a cylindrical bore 130 extending longitudinally through at least a portion of the body 128, an inlet passage 132, and an outlet passage 134. While the structure 104 is shown in FIGS. 2 and 3 as having a first portion disposed within the shell assembly 12 and a second portion disposed outside of the shell assembly 12, the structure 104 could alternatively be disposed entirely within the shell assembly 12 or entirely outside of the shell assembly 12.

The cylindrical bore 130 includes an open end 136 through which the piston 102 and connecting rod 100 may extend. The outer diameter 118 of the piston 102 slidably engages the inner diameter of the bore 130 forming a fluid-tight seal therebetween. One or more gaskets or piston rings (not shown) may be attached to the outer diameter 118 of the piston 102 to facilitate the sealed relationship between the piston 102 and the structure 104 with the bore 130. The second end 116 of the piston cooperates with the bore 130 to form a compression chamber 137 that cyclically increases and decreases in volume as the piston 102 reciprocates within the bore 130.

The inlet passage 132 extends through an outer surface of the body 128 and is in fluid communication with the bore 130. The outlet passage 134 is in fluid communication with the bore 130 and may extend through an end wall 135 of the body 128 of the structure 104. A first valve 138 may be disposed in or adjacent to the inlet 132 while a second valve 140 may be disposed in or adjacent to the outlet 134. The first and second valves 138, 140 may control the flow of fluid into and out of the bore 130, as will be subsequently described. A discharge manifold 142 may be fluidly coupled to the outlet 134 and the second valve 140 and may receive compressed fluid from the compression chamber 137.

The first and second valves 138, 140 may be any suitable type of valve including a check valve or a solenoid valve, for example, or any other fluid-actuated and/or electromagnetically-actuated valve. For example, each of the first and second valves 138, 140 may include a movable valve member 144 and a spring 146. The spring 146 may bias the valve member 144 into a closed position to prevent fluid flow through the respective inlet 132 or outlet 134. When a pressure differential across the inlet 132 or outlet 134 is large enough to generate a sufficiently large force on the corresponding valve member 144 to overcome the biasing force of the corresponding spring 146, the valve member 144 will open to allow fluid flow therethrough.

While the first and second compression mechanisms 18, 24 are described above as being scroll and reciprocating compression mechanisms, respectively, in some embodiments, either or both of the first and second compression mechanisms 18, 24 could be any type of compression mechanism including, for example, scroll, reciprocating, diaphragm, rotary screw, rotary vane, centrifugal, or axial compression mechanisms. The particular type or types of compression mechanisms incorporated into the compressor 10 may be chosen based on an operating efficiency of the particular type of compression mechanism when used to compress a particular fluid to a particular pressure. For example, reciprocating compression mechanisms may be well-suited for relatively high-pressure applications.

The heat exchanger 26 (shown schematically in FIGS. 1-3) may be an inter-stage cooler configured to remove heat from the fluid after it is discharged from the first-compression mechanism 18 and before it is further compressed by the second compression mechanism 24. The heat exchanger 26 may be fluidly coupled to the discharge fitting 20 via a first conduit 150 and may be fluidly coupled to the inlet 132 via a second conduit 152. The heat exchanger 26 may include a coil (not shown), a fan (not shown), and/or other structures or features to facilitate heat transfer from the fluid. In one configuration, the heat exchanger 26 may be disposed downstream of the second compression mechanism 24. If the heat exchanger 26 is disposed downstream of the second compression mechanism 24, the first and second conduits 150, 152 may be merged into a single conduit to connect the discharge fitting 20 and the inlet 132. While a heat exchanger 26 is described for use in conjunction with the second compression mechanism 24, either or both of the first and second conduits 150, 152 may function as a heat exchanger, which may reduce or eliminate the need for the heat exchanger 26. Additionally or alternatively, both of the first and second compression mechanisms 18, 24 and the one or more conduits 150, 152 could be disposed entirely within the shell assembly 12.

The system 30 may include the compressor 10, a fluid source 200, a supply conduit 210, a discharge conduit 220, and a storage container 230. The fluid source 200 may be a source of natural gas such as a local public utility provider, for example. The supply conduit 210 may be an underground or above-ground, natural-gas pipe or a network of natural-gas pipes in communication with the fluid source 200 at a first end. A second end of the supply conduit 210 may be connected to the suction fitting 22 of the compressor 10 to facilitate fluid communication between the fluid source 200 and the first-compression mechanism 18. The supply conduit 210 may include a valve (not shown) to selectively allow and prevent fluid communication between the fluid source 200 and the compressor 10. While the fluid source 200 is described above as a natural-gas, public-utility provider, the fluid source 200 could be any other source of natural gas or other fuel, for example.

The storage container 230 may receive compressed fluid (e.g., natural gas) from the compressor 10. The discharge conduit 220 may be connected to the discharge manifold 142 of the second compression mechanism 24 and may provide fluid communication between the second valve 140 and the storage container 230. The storage container 230 may be a stationary tank disposed at a natural-gas-filling station, for example. Operators of natural-gas-powered vehicles or other machines may connect a fuel tank of the vehicle or machine to the storage container 230 to refill a fuel tank of the vehicle or machine.

Alternatively, the storage container 230 may be an on-board or integrated fuel tank of a natural-gas-powered vehicle or machine. In such embodiments, the operator of the natural-gas-powered vehicle or machine may selectively connect the storage container 230 to the compressor 10 via the discharge conduit 220 to refill the storage container 230.

While the compressor 10 is described above as being incorporated into the system 30 to compress natural gas or other fuel, the compressor 10 could alternatively be incorporated into other systems such as, for example, a refrigeration or climate-control system to compress and circulate a refrigerant through a fluid circuit.

With continued reference to FIGS. 1-3, operation of the compressor 10 will be described in detail. The compressor 10 receives fluid at a suction pressure via the suction fitting 22. From the suction fitting 22, the fluid is drawn into one of the moving fluid pockets 91 defined by the orbiting and non-orbiting scrolls 70, 72 of the first-compression mechanism 18 at the radially outer position. The fluid is compressed as the moving fluid pocket 91 moves from the radially outer position to the radially inner position, as described above. At the radially inner position, the fluid is at the first-discharge pressure that is higher than the suction pressure. The first-discharge pressure may be about 2000 pounds per square inch absolute (137.89 BAR), for example.

The fluid is discharged from the first-compression mechanism 18 via the discharge passage 90 and the discharge fitting 20. From the discharge fitting 20, the fluid may flow through the first conduit 150 to the heat exchanger 26. As the fluid flows through the heat exchanger 26, the fluid is cooled as heat from the fluid is transferred to the heat exchanger 26 and the atmosphere surrounding the heat exchanger 26.

From the heat exchanger 26, the fluid is drawn into the second compression mechanism 24. Rotation of the drive shaft 64 causes the piston 102 to move relative to the structure 104 between a bottom-dead-center position (FIG. 2) and a top-dead-center position (FIG. 3) due to interaction between the second-eccentric portion 69 of the drive shaft 64 and the ring portion 106. Specifically, as the drive shaft 64 rotates, the eccentric portion 69 orbits about a longitudinal and central axis of the drive shaft 64, thereby imparting a force on the ring portion 106. The force applied to the ring portion 106 causes the ring portion 106 to move in a linear direction substantially aligned with a longitudinal axis of the structure 104. Linear motion of the ring portion 106 along the longitudinal axis of the structure 104 causes linear motion of the piston 102 within and relative to the cylindrical bore 130 of the structure 104. When the piston 102 moves under force of the ring portion 106 and drive shaft 64 along the longitudinal axis of the structure 104, the piston 102 moves between the bottom-dead-center position (FIG. 2) and the top-dead-center position (FIG. 3).

When the piston 102 moves from the top-dead-center position to the bottom-dead-center position, a relative vacuum is formed in the compression chamber 137 that may open the first valve 138 and draw the fluid through the inlet 132 and into the compression chamber 137. While the piston 102 moves from the bottom-dead-center position to the top dead center, the first valve 138 is closed and the volume of the compression chamber 137 decreases, which compresses the fluid to the second-discharge pressure.

The second-discharge pressure is higher than the first discharge pressure and may be about 3600 pounds per square inch absolute (248.21 BAR). When the fluid within the compression chamber 137 reaches the second-discharge pressure, the second valve 140 may open, allowing the fluid to flow through the outlet 134 and into the discharge manifold 142. As described above, the fluid may flow from the discharge manifold 142 through the discharge conduit 220 and into the storage container 230.

Figure 4:
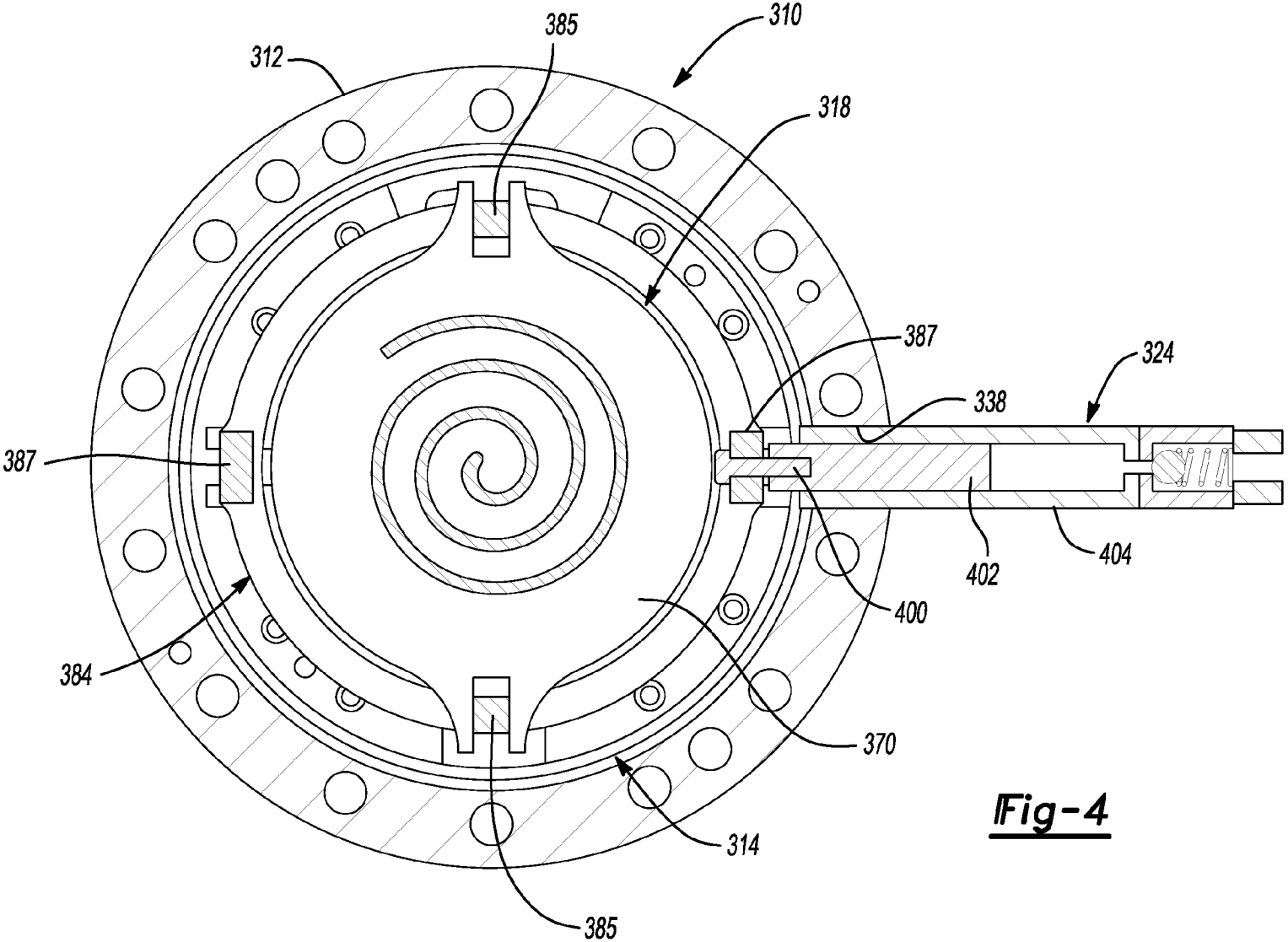
FIG. 4 is a partial top view of another compressor according to the principles of the present disclosure.

With reference to FIG. 4, another embodiment of the compressor 10 is provided and is generally referred to as the compressor 310. The compressor 310 may be generally similar to the compressor 10 and may include a shell 312, a bearing assembly 314, a first compression mechanism 318, and a second compression mechanism 324. The structure and function of the shell 312, the bearing assembly 314, the first compression mechanism 318, and the second compression mechanism 324 may be generally similar to the shell 12, the bearing assembly 14, and the first and second compression mechanisms 18, 24 described above.

The first compression mechanism 318 may include an orbiting scroll 370 meshingly engaging a non-orbiting scroll (not shown) and an Oldham coupling 384 preventing relative rotation between the orbiting scroll 370 and the non-orbiting scroll. The Oldham coupling 384 may include a plurality of first keys 385 and a plurality of second keys 387. The plurality of first keys 385 may slidably engage the orbiting scroll 370 and the plurality of second keys 387 may slidably engage the non-orbiting scroll or the bearing assembly 314.

The second compression mechanism 324 may include a connecting rod or fastener 400, a piston 402, and a structure 404 extending through an opening 338 in the shell 312. The fastener 400 may be connected to the piston 402 and the Oldham coupling 384 at or near one of the plurality of second keys 387, for example. Operation of the first compression mechanism 318 causes cyclical motion of the Oldham coupling 384, which in turn causes the piston 402 to reciprocate relative to the structure 404.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A compressor comprising:

a shell;

a motor assembly disposed within said shell;

a drive shaft powered by said motor assembly;

a first compression mechanism disposed within said shell and driven by said motor assembly, said first compression mechanism including a first scroll member orbiting relative to a second scroll member interleaved with said first scroll member to compress a fluid therebetween;

a second compression mechanism driven by said motor assembly and including a piston reciprocating relative to a cylindrical bore to compress said fluid therebetween; and an Oldham coupling preventing relative rotation between first and second scroll members of said first compression mechanism and connected to said piston and causing said piston to reciprocate relative to said cylindrical bore.

2. The compressor of claim 1, wherein said first compression mechanism compresses said fluid to a first pressure and said second compression mechanism compresses said fluid to a second pressure higher than said first pressure.

3. The compressor of claim 2, wherein said fluid includes natural gas.

4. The compressor of claim 2, wherein said first pressure is 2000 pounds per square inch and said second pressure is 3600 pounds per square inch.

5. The compressor of claim 1, further comprising a conduit disposed outside of said shell and fluidly coupling an outlet of said first compression mechanism and an inlet of said second compression mechanism.

6. The compressor of claim 5, further comprising a heat exchanger in fluid communication with said outlet of said first compression mechanism and said inlet of said second compression mechanism.

7. The compressor of claim 1, wherein said second compression mechanism is at least partially disposed within said shell.

8. A compressor comprising:

a first scroll member having a first scroll wrap extending from a first end plate;

a second scroll member having a second scroll wrap extending from a second end plate, said second scroll wrap being intermeshed with said first scroll wrap;

a discharge passage extending through said first end plate and in fluid communication with a discharge fitting;

a structure in fluid communication with said discharge fitting;

a piston slidably disposed within said structure;

a motor assembly driving said second scroll member and said piston and causing relative orbital movement between said first and second scroll members and relative reciprocating movement between said piston and said structure; and an Oldham coupling engaging said second scroll member and preventing relative rotation between said first and second scroll members, said Oldham coupling drivingly engaging said piston.

9. The compressor of claim 8, further comprising a drive shaft drivingly engaging said second scroll member and transmitting power from said motor assembly to said second scroll member and said piston.

10. The compressor of claim 8, wherein said first and second scroll members cooperate to compress a fluid to a first pressure and said piston and said structure cooperate to compress said fluid to a second pressure higher than said first pressure.

11. The compressor of claim 10, wherein said first pressure is 2000 pounds per square inch and said second pressure is 3600 pounds per square inch.

12. The compressor of claim 10, wherein said fluid includes natural gas.

13. The compressor of claim 8, further comprising a first valve controlling fluid flow through an inlet of said structure and a second valve controlling fluid flow through an outlet of said structure.

14. A system comprising:

a compressor including a motor assembly driving a first compression mechanism and a second compression mechanism, said first compression mechanism including a first scroll member orbiting relative to a second scroll member to compress a fluid therebetween, said second compression mechanism including a piston reciprocating relative to a cylindrical bore to compress said fluid therebetween, said compressor including an Oldham coupling preventing relative rotation between said first and second scroll members and connected to said piston and causing said piston to reciprocate relative to said cylindrical bore;

a supply conduit providing fluid communication between a natural gas supply and a suction inlet of said first compression mechanism; and a discharge conduit providing fluid communication between said second compression mechanism and a natural gas storage tank.

15. The system of claim 14, further comprising a heat exchanger in fluid communication with an outlet of said first compression mechanism and an inlet of said second compression mechanism.

16. The system of claim 14, wherein said compressor includes a drive shaft drivingly engaging said second scroll member and transmitting power from said motor assembly to said second scroll member and said piston.

* * * * *